United States Patent [19]

Gentes

[11] Patent Number: 5,007,141

[45] Date of Patent: Apr. 16, 1991

[54] STRAP RETAINER FOR HEAD GEAR

[75] Inventor: James J. Gentes, Soquel, Calif.

[73] Assignee: Giro Sport Design, Soquel, Calif.

[21] Appl. No.: 373,417

[22] Filed: Jun. 30, 1989

[51] Int. Cl.[5] ..... A44B 11/00; A42B 7/00

[52] U.S. Cl. ..... 24/163 R; 24/265 R; 2/421

[58] Field of Search ..... 24/163 R, 163 K, 168, 24/171, 615, 573.3, 573.5, 301, 302, 300, 645, 464, 656, 265 BC, 265 R; 2/421, 425

[56] References Cited

U.S. PATENT DOCUMENTS

| | | | |
|---|---|---|---|
| 374,177 | 12/1887 | Detrick | 24/265 R |
| 960,593 | 6/1910 | Smith | 24/171 |
| 2,551,165 | 5/1951 | Rochat | 24/163 R |
| 3,990,113 | 11/1976 | Coenen | 2/421 |
| 4,642,853 | 2/1987 | Plesniarski et al. | 24/163 R |
| 4,903,349 | 2/1990 | Arai | 2/421 |

*Primary Examiner*—Victor N. Sakran

*Attorney, Agent, or Firm*—Rosenblum, Parish & Bacigalupi

[57] ABSTRACT

A strap retainer including a base plate and a disk ring, having a central aperture, joined together at their sides by two parts, and an elastic band circumscribing the posts so as to form a pair of passageways, one on each side of the elastic band, through which each strap of a pair of straps may be respectively passed. The embodiment further includes an identification cap which is mated with the aperture of the disk ring and may be readily replaced by similar disks of different colors or designs. When both straps are simultaneously pulled in the same direction the straps engage and stretch the elastic band causing the band to initially resist displacement of the straps with respect to the retainer and causing the straps and band to be drawn against the base plate and disk ring so as to further resist the displacement of the straps, but when only one strap is pulled, the elastic band is not so engaged and the strap is allowed to freely pass through its respective passageway.

21 Claims, 4 Drawing Sheets

STRAP RETAINER FOR HEAD GEAR

BACKGROUND OF THE INVENTION

1. Field of the Invention

The present invention relates generally to retention systems for headgear and more particularly, to an adjustable strap retainer for a bicycle helmet.

2. Brief Description of the Prior Art

Numerous strap retention systems have been developed over the years to hold a hat or helmet on a wearer's head. Headgear retention systems typically include a set of front and rear straps fastened together at a point proximate the wearer's chin. A buckle or clip will also typically be used to bind the ends of the straps together and other guides or fastening means will be used when it is necessary to position the straps with respect to the wearer's head.

Prior art retention systems which use clips, buckles and guides may adequately hold the headgear in place, but such fastening means are often bulky and nonaerodynamic. Bulky structured fastening means are also uncomfortable to the wearer because they tend to rub up-against and irritate the wearer's skin. Most importantly, such fastening means cannot be quickly and easily adjusted by the wearer because the straps must first be unbuckled, unclipped or untied in order to be adjusted.

Accordingly, it is an object of the present invention to provide a strap retainer which can be quickly and easily adjusted by pulling either of two straps being retained.

Another object of the present invention is to provide a strap retainer which lays smooth and flush against the side of a wearer's head so as to prevent skin irritation.

Still another object of the present invention is to provide a strap retainer which can be readily modified by the wearer to change its color scheme or readily modified by the seller to change the displayed logo or trademark.

SUMMARY OF THE PRESENT INVENTION

Briefly, a preferred embodiment of the present invention includes a base plate and a disk ring, having a central aperture, joined together at their sides by two posts, and an elastic band circumscribing the posts so as to form a pair of passageways, one on each side of the elastic band, through which each strap of a pair of straps may be respectively passed. The embodiment further includes an identification cap which is mated with the aperture of the disk ring and may be readily replaced by similar disks of different colors or designs. When both straps are simultaneously pulled in the same direction the straps engage and stretch the elastic band causing the band to initially resist displacement of the straps with respect to the retainer and causing the straps and band to be drawn against the base plate and disk ring so as to further resist the displacement of the straps, but when only one strap is pulled, the elastic band is not so engaged and the strap is allowed to freely pass through its respective passageway.

An important advantage of the present invention is that it provides a strap retainer which facilitates rapid strap adjustment when a single strap is pulled and restricts the mobility of the straps when both straps are pulled.

Another advantage of the present invention is that it provides a streamlined and aerodynamic structure which will not irritate most wearers if it were to come in contact with the wearer's skin.

Still another advantage of the present invention is that it provides a means for readily changing the color scheme or external design of the strap retainer without requiring its complete replacement.

These and other objects and advantages of the present invention will no doubt become apparent to those of ordinary skill in the art after having read the following detailed description of the preferred embodiments illustrated in the several figures of the drawing.

DESCRIPTION OF THE PREFERRED EMBODIMENT

Figure 1:
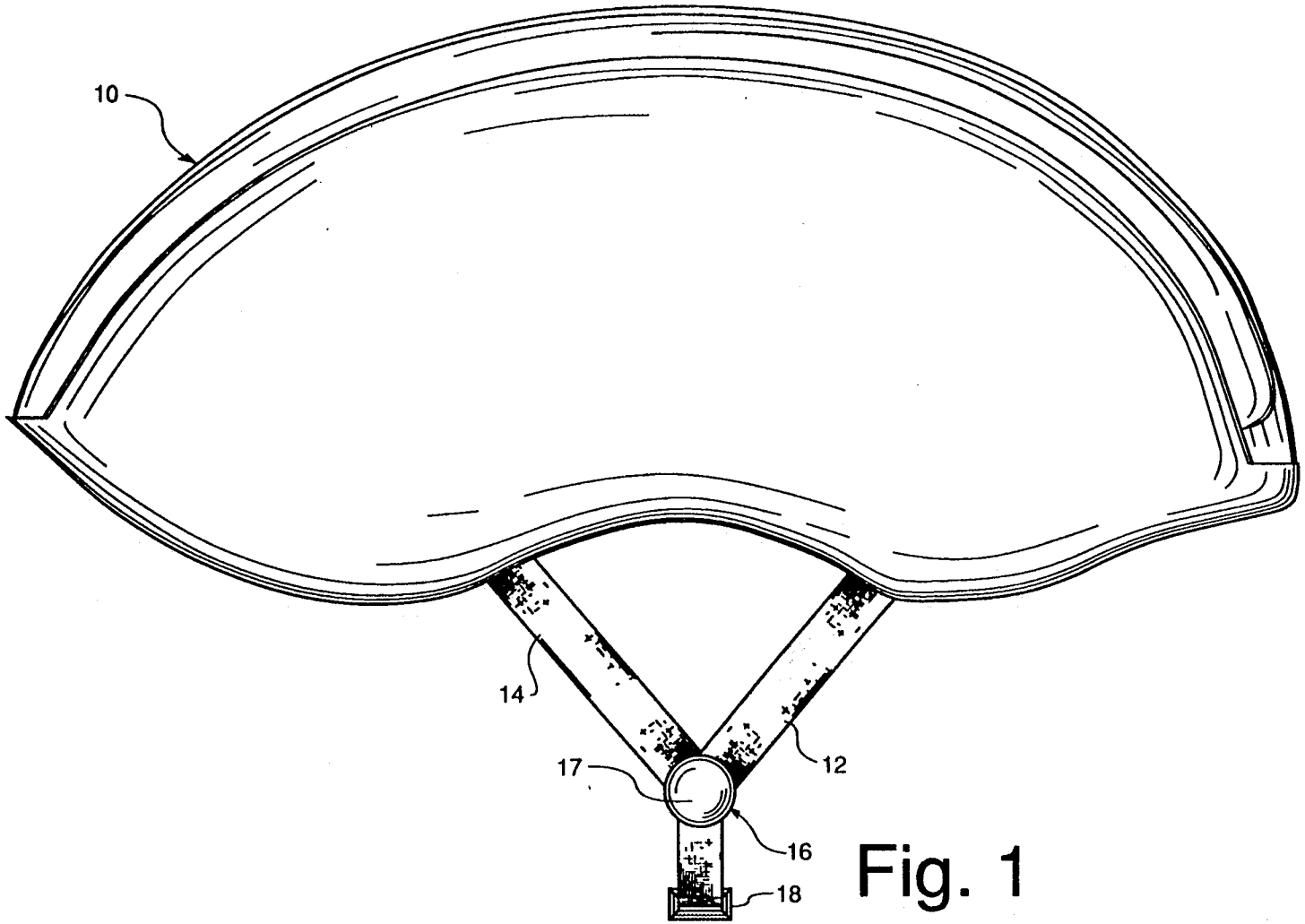
FIG. 1 is a right side elevational view showing a bicycle helmet having a strap retainer in accordance with the present invention.

Referring now to FIG. 1 of the drawing, a presently preferred embodiment of the present invention is shown in side elevation view as it would be used with a type of headgear, such as the bicycle helmet shown generally as 10. The helmet 10 also includes a front strap 12 and a rear strap 14 which are attached to points (not shown) within the structure of the helmet 10 and which are guided together and retained by a strap retainer shown generally as the member 16. The front and rear straps are generally formed from nylon or cloth material and are fastened at their free ends by a fastening means 18, such as a clip or buckle, so that all of the straps can be joined together at a position proximate the wearer's chin and thereby secure the helmet to the wearer's head.

Figure 2:
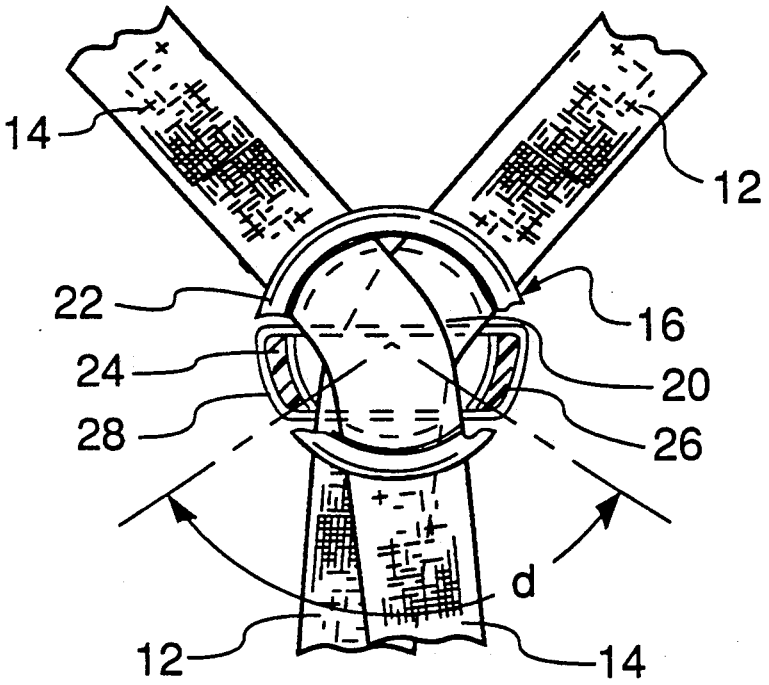
FIG. 2 is a partially-broken, side elevational view thereof with the identification disk removed to further illustrate structural details.

The strap retainer 16 can be better illustrated now with reference to FIG. 2, which depicts a partially-broken, partially cross-sectioned, side elevation view of the preferred embodiment of the present invention. The retainer 16 is comprised of two parts: a molded, plastic body having a base plate 20, a disk ring 22, and two posts 24 and 26; and an elastic band 28 which is stretched over the molded plastic body so as to circumscribe the posts and fit between the plate 20 and the ring 22. The posts 24 and 26 are affixed at one end to the circumference of plate 20 and at the other end to the flat underside of ring 22 so as to form a passageway for the straps 12 and 14 therebetween on either side of the elastic band 28.

The posts or connectors 24 and 26 are symmetrically positioned around the plate 20 and ring 22. Hence, the posts can be positioned opposite one another so as to be separated by an angle of approximately 180 degrees with respect to the axis of the plate 20, or otherwise positioned so as to have a smaller angle of separation. As shown in FIG. 2, the posts 24 and 26 are separated by the angle d, which is typically between 100 and 125 degrees. The angle d should be large enough such that there is sufficient room for at least the width of one strap to pass through the area between the posts as defined by the angle d.

In addition, the positioning of the posts 24 and 26 should make it possible for the straps to smoothly extend, without buckling or twisting, between the retainer 16 and the strap's points of attachment with the helmet. The length of the posts 24 and 26 is at least approximately equal to the thickness of two straps such that both straps 12 and 14 may pass through the passageway formed between the plate 20 and ring 22.

The elastic band 28 is formed from a resilient material, such as rubber, having a viscous outer surface which will engage and hold the less viscous surface of the straps. To form the functioning strap retainer 16 the straps are first inserted into the main passage of the retainer 16, the flexible band 28 is then stretched over either the plate 20 or the ring 22 and one of the straps so that it positioned between the straps and stretched so as to circumscribe the lobes 24 and 26, and the identification cap 17 (shown with reference to FIGS. 1 and 3) is inserted into the aperture of the disk ring 22. Thus, as shown in FIG. 2, strap 12 passes through the passageway formed between the base plate 20 and one side of the flexible band 28 while strap 14 passes through the passageway formed between the disk ring 22 and the other side of the flexible band 28.

Positioning the flexible band 28 between the two straps 12 and 14 makes it possible to take advantage of the resistance created by the viscous nature of the flexible band against the straps.

Figure 3:
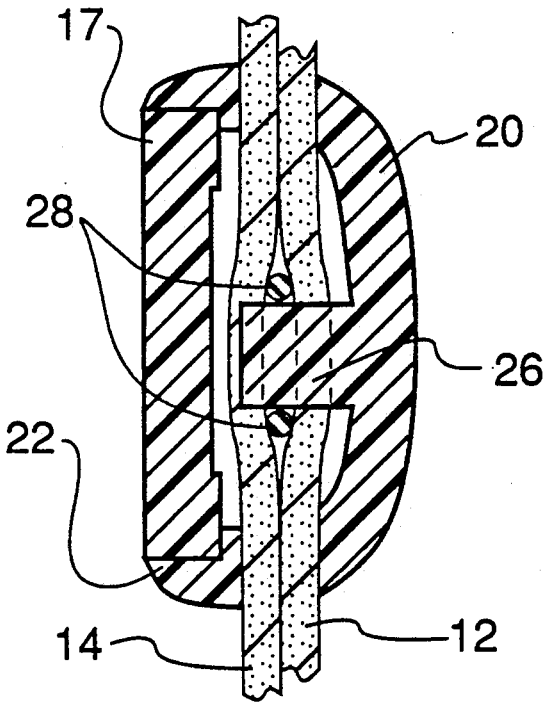
FIG. 3 is a partially-broken, cross-sectional view thereof along the axis of the disk ring.

As will be shown with reference to the cross-section view of the preferred embodiment of the present invention depicted in FIG. 3, additional strap displacement resistance is provided by the constricted nature of the area within the passageway of the retainer 16. When both straps are pulled in the same direction, both straps engage the elastic band 28 stretch it in the direction of motion of the straps, thereby causing the combination of the straps and the band to be drawn toward the plate 20 and the ring 22, the height of which is less than the combined thickness of the straps and the flexible band 28, thereby causing the straps to bunch up within the passageway and further restrict the mobility of the straps.

Since it is primarily the edges of both the plate 20 and ring 22 which contact the straps and cause the straps to bind against them, both the plate and ring can have central apertures or recesses as shown in FIG. 3. However, insertion of the identification cap 17 into the aperture of the ring 22 does serve to provide some addition displacement resistance to the retainer 16. Small recesses within the plate 20 and cap 17 will allow a single strap to be pulled without engaging the elastic band 28 because there will be more room to push the band out of the way.

In addition, it should also be noted that as the angle at which the straps diverge from the retainer 16 toward the helmet increases, so does the degree of control which can be exerted by the retainer 16 against displacement of the straps when both straps are simultaneously pulled. A larger angle of separation between the straps, between the retainer 16 and the helmet 10, produces more restriction on the mobility of the straps when the two straps are pulled in the same direction because the straps are caused to bunch up more within the passageways of the retainer 16.

Although the present invention is described as being used in the manner depicted in FIG. 1, the present invention is not limited to the application shown and could likewise be used for a wide variety of different applications, such as for retaining straps on camping gear or other sporting equipment.

Although the preferred embodiment of the present invention requires that the identification cap 17 be readily removable from the disk ring 22, these two pieces may also be integrally constructed to save on manufacturing costs. When the disk ring and identification disk are integrally formed, this integral piece is generally monochromatic and must have the logo or trademark either formed at the same time or applied using other techniques. However, by making the identification cap 17 readily removable, a large variety of caps having different external designs and colors may be economically formed, thereby allowing the wearer to replace the identification cap as desired and thereby allowing different manufacturers to use the same retainer, but uniquely identify it as there own.

Figure 4:
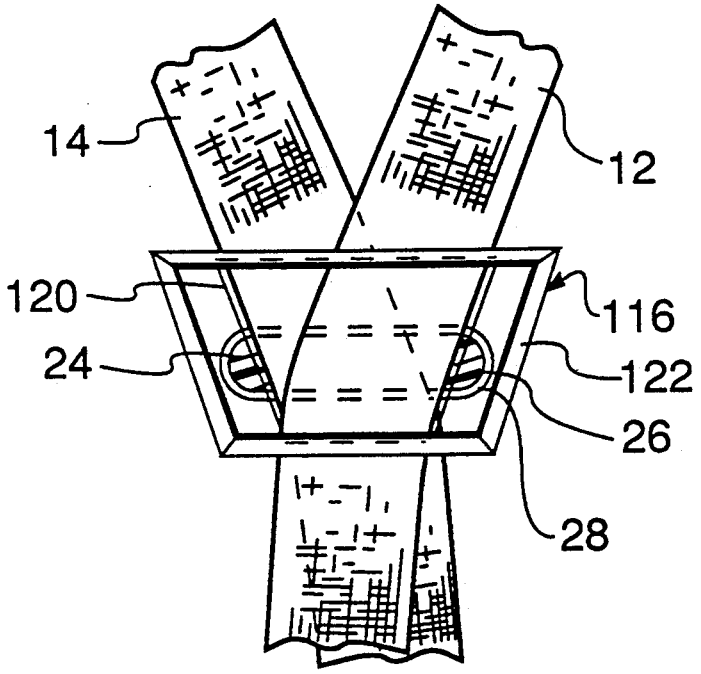
FIG. 4 a partially-broken, side elevational view of an alternative embodiment of the present invention.

FIG. 4 shows an alternative embodiment of the present invention in which the disk plate 20 and disk ring 22 of the preferred embodiment are replaced by similarly functional polygonal-shaped members 120 and 122 respectively. Since the function of the retainer 116 is substantially identical to that of the retainer 16, the remainder of the components are identified by the same numerals as were used to identify the components of the preferred embodiment.

Although the present invention has been described in terms of specific embodiments, it is anticipated that alterations and modifications thereof will no doubt become apparent to those skilled in the art, such as the modification to the basic shape of the molded plastic retainer shown in FIG. 4. It is therefore intended that the following claims be interpreted as covering all such alterations and modifications as fall within the true spirit and scope of the invention.

What I claim is:

1. A strap retainer, comprising:

a first generally planar configured member;

a second generally planar configured member disposed in spaced-apart relationship to said first member;

a first post connecting one side of said first member to a corresponding side of said second member;

a second post disposed in spaced-apart relationship to said first post and connecting another side of said first member to another corresponding side of said second member; and resilient band means disposed about said posts and cooperating with said first and second members and said first and second posts to form a pair of passageways, one on each side of said band means, through which each strap of a pair of straps may be respectively passed, whereby independently pulling on one of said straps results in said strap being freely pulled through its respective passageway, but simultaneously pulling on both of said straps results in said straps combining to engage and stretch said band means causing said band means to resist displacement of said straps and causing said straps and said band means to bind against said first and second members so as to further resist displacement of said straps.

2. A strap retainer as recited in claim 1, wherein said first member has an aperture formed therein between said first and second posts, and wherein said retainer further comprises a cap which mates with and closes said aperture.

3. A strap retainer as recited in claim 2, wherein said cap is removably mated with said aperture and is readily replaceable by a similarly shaped cap.

4. A strap retainer as recited in claim 2, wherein said resilient band has a viscous outer surface for readily engaging said straps when both of said straps are pulled.

5. A strap retainer as recited in claim 2, wherein said cap serves the purpose of further restricting the displacement of one of said straps within its passageway.

6. A strap retainer as recited in claim 1, wherein said posts are spaced apart at an acute angle with respect to the axis of the plane of said first member.

7. A strap retainer as recited in claim 1, wherein said first and second members have generally disk-shaped configurations.

8. A strap retainer as recited in claim 7, wherein the diameter of said first member is larger than the diameter of said second member.

9. A strap retainer as recited in claim 1, wherein said first and second members have generally polygonal-shaped configurations.

10. A strap retainer as recited in claim 1, wherein said members and said posts are integrally molded.

11. A strap retainer as recited in claim 1, wherein the spaced-apart distance between said first and second post is at least as large as the width of one of said straps.

12. A strap retainer as recited in claim 1, wherein the spaced-apart distance between said first and second members is at least as large as twice the thickness of one of said straps.

13. A strap retainer as recited in claim 12, wherein the spaced-apart distance between said first and second post is at least as large as the width of one of said straps.

14. A strap retainer for adjustably retaining a pair of straps, comprising:

a first generally planar polygonal configured member;

a second generally planar polygonal configured member disposed in spaced-apart relationship to said first member, the plane of said first member being substantially parallel to the plane of said second member;

a first connector for joining a first side of said first member to a corresponding first side of said second member;

a second connector for joining a second side of said first member to a corresponding second side of said second member; and elastic band means disposed around said first and second connectors and cooperating with said connectors and said members to form a pair of passageways, one on each side of said band means, through which each strap of said pair of straps may be respectively passed, whereby said straps combine to engage and stretch said band means when both of said straps are simultaneously pulled through their passageways causing said band means to resist displacement of said straps and causing said straps and said band means to bind against said members to further resist displacement of said straps, but one of said straps may be freely displaced when pulled through its respective passageway independent of the other strap.

15. A strap retainer for adjustably retaining a pair of straps as recited in claim 14, wherein said first member has an aperture formed therein between said first and second sides.

16. A strap retainer for adjustably retaining a pair of straps as recited in claim 15, wherein said retainer further includes a readily removable cap for mating with said aperture and further restricting the displacement of one of said straps when both straps are simultaneously pulled through their passageways.

17. A strap retainer for adjustably retaining a pair of straps as recited in claim 16, wherein said members and said connectors are integrally molded from a plastic-like material.

18. A strap retainer for adjustably retaining a pair of straps as recited in claim 17, wherein the width of the space between said first and second connectors is at least as large as the width of one of said straps.

19. A strap retainer for adjustably retaining a pair of straps as recited in claim 17, wherein the thickness of the space between said first and second members is at least as large as twice the thickness of one of said straps.

20. A strap retainer for adjustably retaining a pair of straps each connected to a helmet or hat on one end, the strap retainer comprising:

a first generally planar configured member;

a second generally planar configured member disposed in spaced-apart relationship to said first member;

a first post connecting one side of said first member to a corresponding side of said second member;

a second post disposed in spaced-apart relationship to said first part and connecting another side of said first member to another corresponding side of said second member; and resilient band means disposed about said post to form a pair of passageways, one on each side of said band means, through which one of said straps may respectively pass prior to connection to said helmet, whereby pulling on one of said straps results in said strap freely pulling through its respective passageway so as to adjust the relative position of said straps, but simultaneously pulling on both of said straps causes said straps to engage said band means and bind against said members so as to resist displacement of said straps.

21. A strap retainer for adjustably retaining a pair of straps as recited in claim 20, wherein said posts are connected to said members at positions which allow said straps to diverge toward said helmet at an angle between 30 and 60 degrees.

* * * * *